US010935922B2

(12) United States Patent
Nakayama

(10) Patent No.: US 10,935,922 B2
(45) Date of Patent: Mar. 2, 2021

(54) IMAGE FORMING APPARATUS INCLUDING LOCKING MECHANISM AND COVERING WITH SLIDE MEMBER

(71) Applicant: KYOCERA Document Solutions Inc., Osaka (JP)

(72) Inventor: Toru Nakayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/500,076

(22) PCT Filed: Mar. 13, 2018

(86) PCT No.: PCT/JP2018/009749
§ 371 (c)(1),
(2) Date: Oct. 1, 2019

(87) PCT Pub. No.: WO2018/186121
PCT Pub. Date: Oct. 11, 2018

(65) Prior Publication Data

US 2020/0379403 A1 Dec. 3, 2020

(30) Foreign Application Priority Data

Apr. 6, 2017 (JP) ..... JP2017-075927

(51) Int. Cl.
*G03G 21/16* (2006.01)
*G03G 15/00* (2006.01)

(52) U.S. Cl.
CPC ..... *G03G 21/1647* (2013.01); *G03G 15/50* (2013.01)

(58) Field of Classification Search
CPC ..... G03G 21/1647; G03G 15/50
See application file for complete search history.

(56) References Cited

U.S. PATENT DOCUMENTS 4,908,659 A * 3/1990 Ishii ..... G03G 21/1628 292/128
8,509,651 B2 * 8/2013 Tsukijima ..... G03G 15/0856 399/114
9,470,020 B2 10/2016 Eto
2006/0159486 A1 * 7/2006 Kweon ..... G03G 15/0896 399/110

(Continued)

FOREIGN PATENT DOCUMENTS

JP H11-184329 A 7/1999
JP 2008-096476 A 4/2008

(Continued)

*Primary Examiner* — Susan S Lee
(74) *Attorney, Agent, or Firm* — Studebaker & Brackett PC

(57) ABSTRACT

An image forming apparatus (1) includes a front covering (2) and a locking mechanism (2). The front covering (2) is opened and closed in attachment or detachment of a toner container (15). The locking mechanism (3) locks the front covering (2). The term "lock" refers to the front covering (2) being kept closed with no external force acting on the front covering (2). The toner container (15) includes a protrusion (151). Only when the protrusion is located at a specific position of the toner container (15), the locking mechanism (3) operates according to opening or closing of the front covering (2).

7 Claims, 8 Drawing Sheets

(56) References Cited

U.S. PATENT DOCUMENTS

| | | | | |
|---|---|---|---|---|
| 2012/0039625 | A1* | 2/2012 | Sekido | G03G 21/1633 399/110 |
| 2014/0003825 | A1* | 1/2014 | Yamaguchi | G03G 15/55 399/9 |
| 2016/0083979 | A1 | 3/2016 | Eto | |

FOREIGN PATENT DOCUMENTS

| | | | |
|---|---|---|---|
| JP | 2009-009002 | A | 1/2009 |
| JP | 2016-062047 | A | 4/2016 |

* cited by examiner

IMAGE FORMING APPARATUS INCLUDING LOCKING MECHANISM AND COVERING WITH SLIDE MEMBER

TECHNICAL FIELD

The present invention relates to an image forming apparatus.

BACKGROUND ART

An image forming apparatus disclosed in Patent Literature 1 includes a toner container, a covering, a sensor, and a controller. The sensor detects presence or absence of the toner container and detects opening and closing of the covering. The covering is opened and closed in replacement of the toner container. The controller permits operation for image formation on paper only in a state in which the toner container is attached and the covering is closed.

CITATION LIST

Patent Literature

[Patent Literature 1] Japanese Patent Application Laid-Open Publication No. H11-184329.

SUMMARY OF INVENTION

Technical Problem

However, the image forming apparatus disclosed in Patent Literature 1 may permit the operation for image formation on paper even in a situation in which a toner container that is not an authorized toner container is attached. Therefore, it may be impossible to restrict use of such an unauthorized toner container.

The present invention has been made in view of the foregoing and has its object of providing an image forming apparatus capable of restricting use of an unauthorized toner container.

Solution to Problem

An image forming apparatus according to the present invention includes a covering and a locking mechanism. The covering is opened and closed in attachment or detachment of a toner container. The locking mechanism locks the covering. The toner container includes a protrusion. Only when the protrusion is provided at a specific position of the toner container, the locking mechanism operates according to opening or closing of the covering.

Advantageous Effects of Invention

According to the image forming apparatus of the present invention, use of an unauthorized toner container can be restricted.

DESCRIPTION OF EMBODIMENTS

Figure 1:
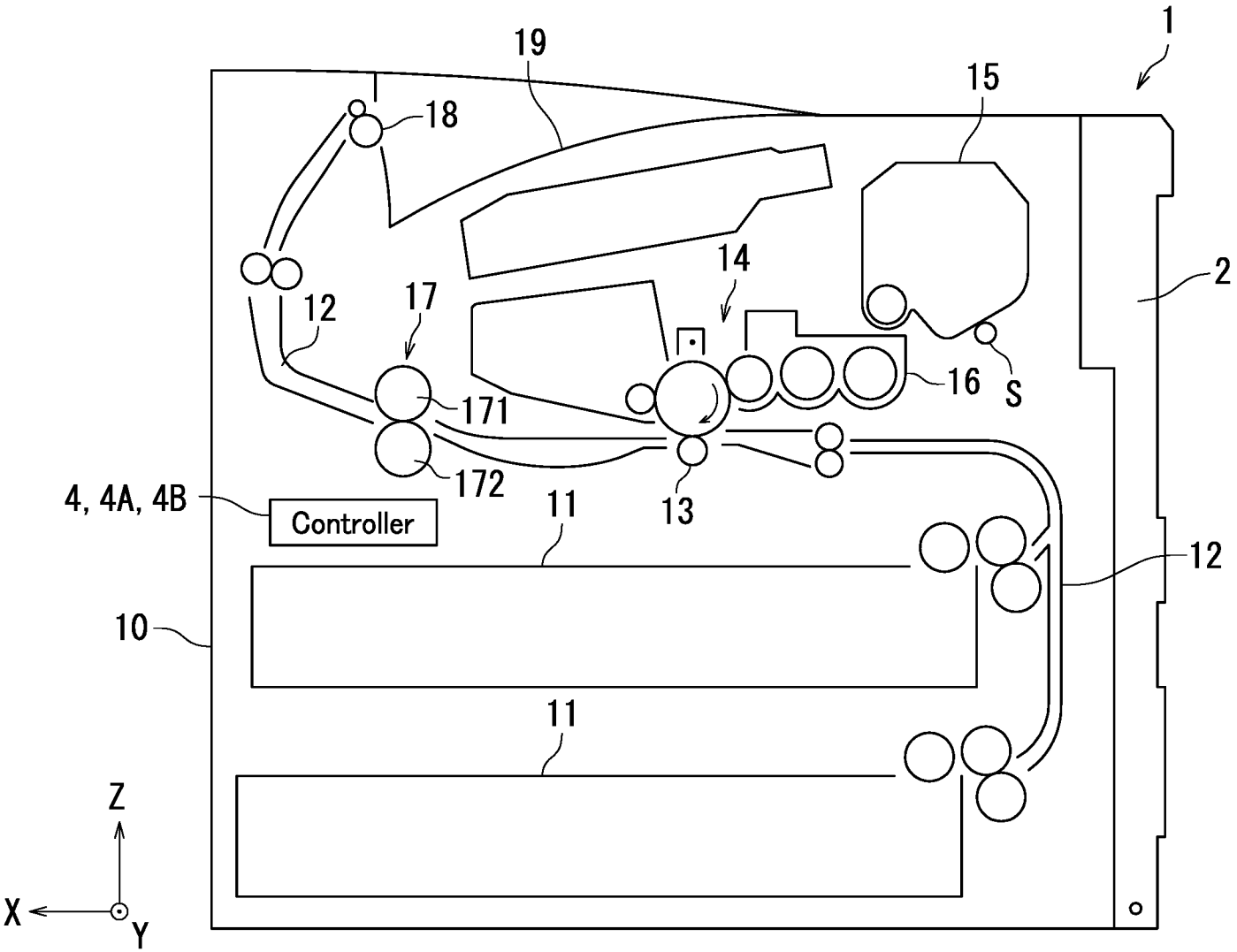
FIG. 1 is a side view of a configuration of an image forming apparatus according to an embodiment of the present invention.

The following describes an embodiment of the present invention with reference to accompanying drawings (FIGS. 1 to 8). Note that elements that are the same or equivalent are indicated by the same reference signs in the drawings and description thereof will not be repeated.

Figure 2:
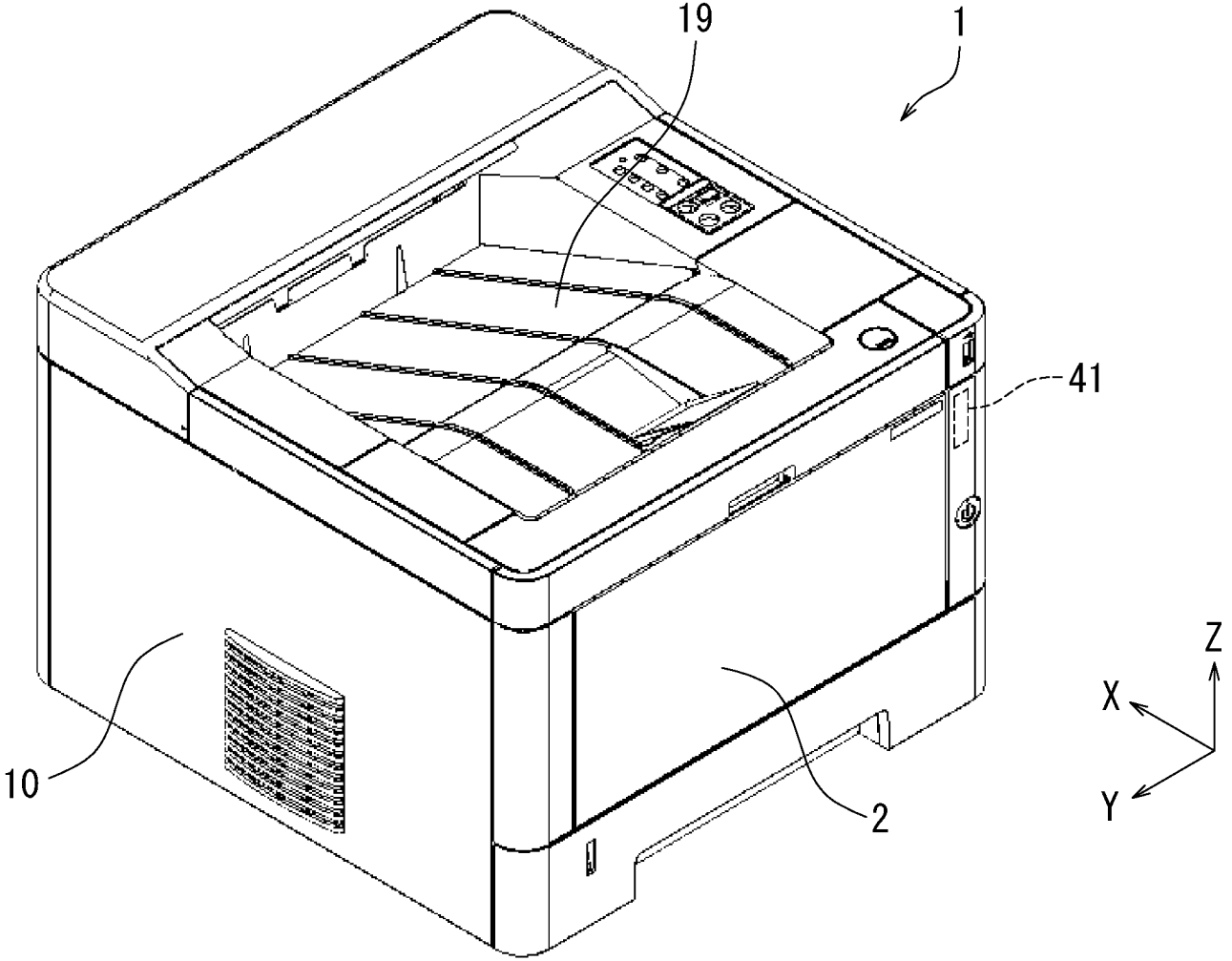
FIG. 2 is a perspective view of the configuration of the image forming apparatus.

The following first describes an image forming apparatus 1 according to an embodiment of the present invention with reference to FIGS. 1 and 2. FIG. 1 is a diagram illustrating a configuration of the image forming apparatus 1. FIG. 2 is a perspective view of the configuration of the image forming apparatus 1. As illustrated in FIG. 1, the image forming apparatus 1 is a printer. The image forming apparatus 1 includes a casing, 10, paper feeding cassettes 11, a conveyance section 12, an image forming section 14, a toner container 15, a fixing section 17, an ejection section, 18, an exit tray 19, a controller 4, and a sensor S. The casing 10 includes a front covering 2. The image forming section 14 includes a transfer section 13 and a developing section 16.

FIG. 1 illustrates an X axis, a Y axis, and a Z axis extending orthogonally to one another. The X axis and the Y axis are parallel to a horizontal plane. The Z axis is parallel to a perpendicular direction. In the following description, a positive side in an X-axis direction may be referred to as a rear side and a negative side in the X-axis direction may be referred to as a front side.

The casing 10 accommodates each paper feeding cassette 11, the conveyance section 12, the image forming section 14, the toner container 15, the fixing section 17, the ejection section 18, the controller 4, and the sensor S.

The paper feeding cassette 11 feeds paper to the conveyance section 12. The conveyance section 12 conveys the paper to the ejection section 18 via the transfer section 13 and the fixing section 17. The paper corresponds to an example of a "recording medium".

The image forming section 14 forms an image on the paper. The image forming section 14 includes a photosensitive drum. An electrostatic latent image is formed on the photosensitive drum. The toner container 15 contains a toner. The toner container 15 replenishes the developing section 16 with the toner. The developing section 16 supplies the toner to the electrostatic latent image to form a toner image. The transfer section 13 transfers the toner image formed on the photosensitive drum onto the paper. Through the above, an image is formed on the paper.

The fixing section 17 includes a heating roller 171 and a pressure roller 172. The fixing section 17 nips the paper between the heating roller 171 and the pressure roller 172 for application of heat and pressure to fix the image formed on the paper to the paper. The ejection section 18 ejects the paper onto the exit tray 19. The paper ejected from the ejection section 18 is placed on the exit tray 19.

The front covering 2 constitutes a part of one of side surfaces of the casing 10. Specifically, the front covering 2 constitutes a side surface located on a negative side (front side) of the casing 10 in an X-axis direction. The front covering 2 corresponds to an example of a "covering".

The sensor S detects whether or not the toner container 15 is attached to the image forming apparatus 1. The sensor S transmits to the controller 4 a detection signal indicating whether or not the toner container 15 is attached.

The controller 4 controls operation of the image forming apparatus 1. The controller 4 includes a processor 4A and storage 4B. The processor 4A includes for example a central processing unit (CPU). The storage 4B includes memory such as semiconductor memory and may include a hard disk drive (HDD). The storage 4B stores a control program therein. The processor 4A controls the operation of the image forming apparatus 1 through execution of the control program.

As illustrated in FIG. 2, the exit tray 19 is located on an upper surface of the casing 10. Specifically, the exit tray 19 serves as an upper covering of the casing 10.

The image forming apparatus 1 further includes an interlock switch 41. The interlock switch 41 is dispose on a positive side (rear side) of the front covering 2 in the X-axis direction. The interlock switch 41 is off during the front covering 2 being unlocked and is on during the front covering 2 being locked. The term "lock" in the embodiment of the present invention refers to a state in which the front covering 2 remains firmly closed with no external force acting on the front covering 2. The phrase no external force acting on the front covering 2 refers to for example a state in which a user does not touch the front covering 2.

During the interlock switch 41 being off, the controller 4 restricts the operation of the image forming section 14. Specifically, in a state in which the interlock switch 41 is off, the controller 4 inhibits the operation of the image forming section 14.

Figure 3:
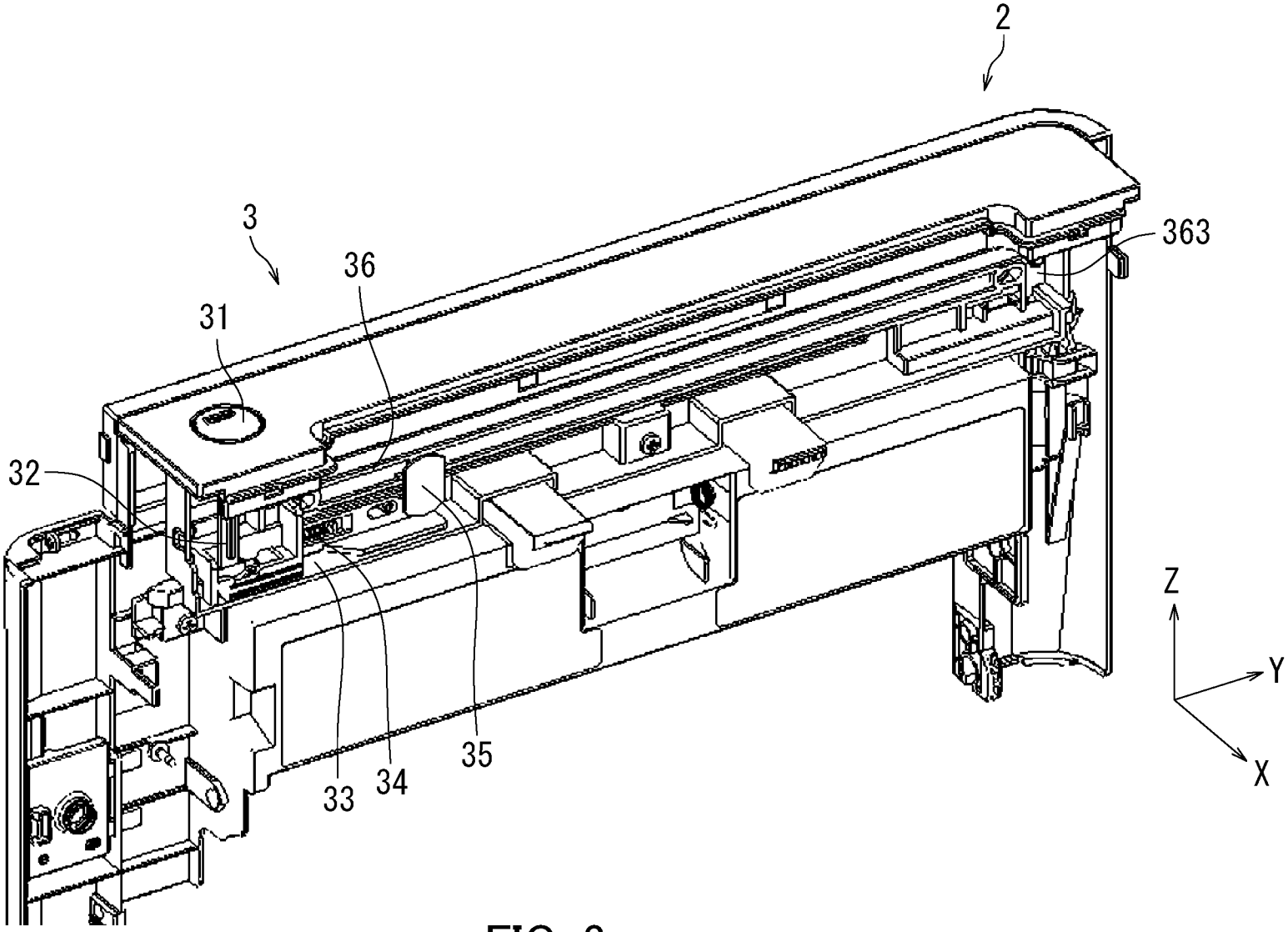
FIG. 3 is a perspective view of a configuration of a front covering.
Figure 4:
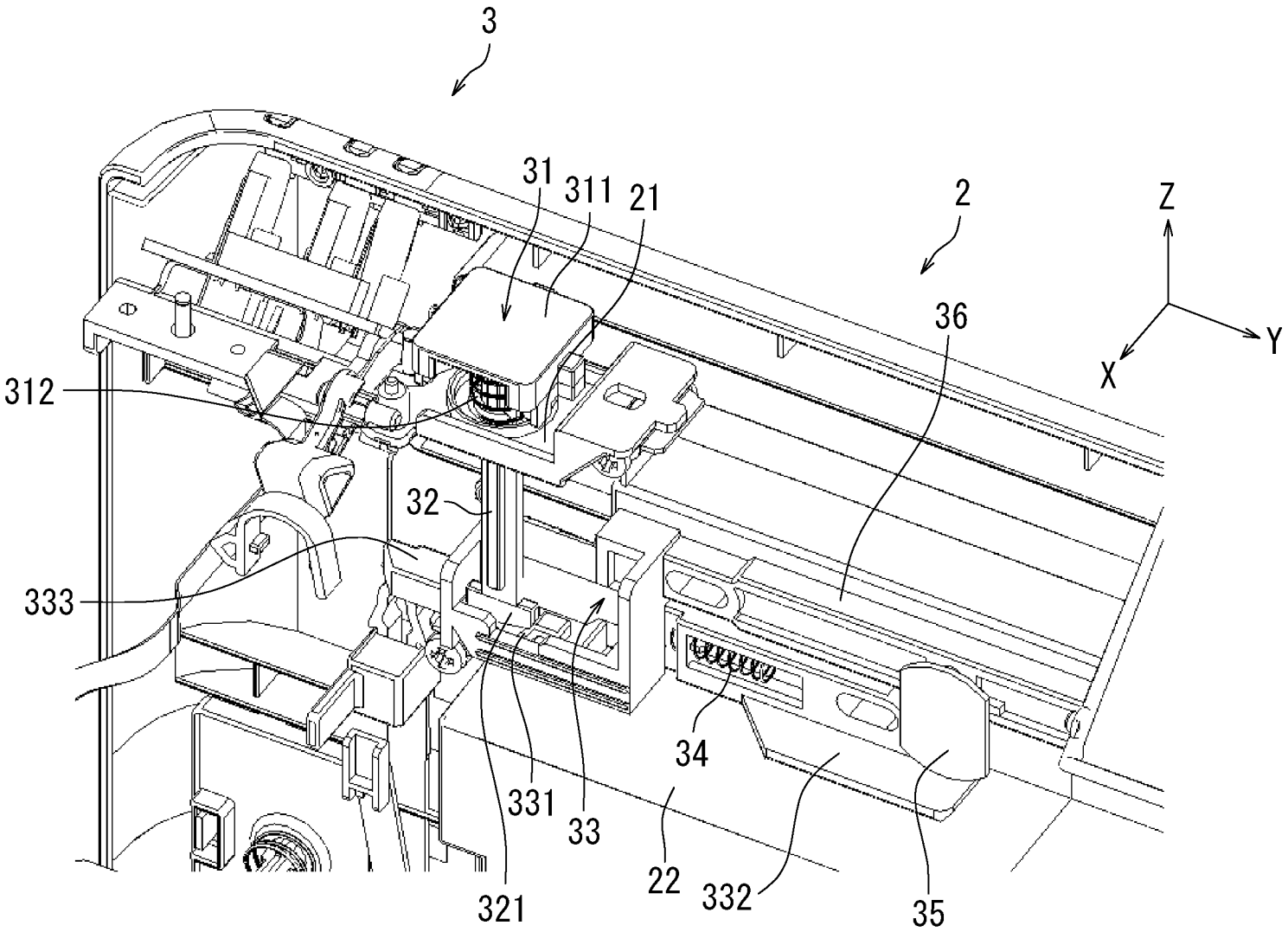
FIG. 4 is a perspective view of a configuration of a locking mechanism.

The following describes a configuration of the locking mechanism 3 with reference to FIGS. 1 to 4. FIG. 3 is a perspective view of a configuration of the front covering 2. FIG. 4 is a perspective view of the configuration of the locking mechanism 3.

As illustrated in FIGS. 3 and 4, the locking mechanism 3 is disposed in a rear surface of the front covering 2. The locking mechanism 3 includes a pressing member 31, a rod 32, a first slide member 33, an urging member 34, a linkage member 35, and a second slide member 36. The first slide member 33 corresponds to an example of a "slide member". As illustrated in FIG. 3, the second slide member 36 includes an engaging member 363. The engaging member 363 is disposed at an end of the second slide member 36 in a positive direction of the Y axis.

As illustrated in FIG. 4, the pressing member 31 includes a button 311 and an urging member 312. The front covering 2 includes a rib 21 and a frame 22.

The button 311 is pressed by the user for unlocking the front covering 2. The urging member 312 urges the button 311 in a positive direction of the Z axis (upward). The urging member 312 includes for example a coil spring. The urging member 312 is disposed at a location between the rib 21 and the button 311.

The rib 21 stands on the front covering 2. The rib 21 protrudes from the front covering 2 in a positive direction of the X axis (rearward). The rib 21 is in a plate shape extending in a Y-axis direction. The rib 21 supports a lower end of the urging member 312.

The rod 32 is in a column shape and transmits pressing force applied to the button 311 to the first slide member 33. Specifically, the rod 32 includes a wedge member 321. The rod 32 has an upper end engaged with the button 311 and a lower end where the wedge member 321 is disposed. The pressing force applied to the button 311 is provided to the first slide member 33 via the wedge member 321.

The frame 22 stands on the front covering 2. The frame 22 protrudes from the front covering 2 in the positive direction of the X axis (rearward). The frame 22 is in a plate shape extending in the Y-axis direction.

The first slide member 33 is slidable in the Y-axis direction. Specifically, the first slide member 33 is slideable on an upper surface of the frame 22 in the Y-axis direction. The first slide member 33 includes a tapered surface 331, a tapered member 332, and an engaging member 333. The tapered surface 331 serves as a surface of an end of the first slide member 33 on one side (negative side in the Y-axis direction). The tapered surface 331 is in contact with the wedge member 321. An end of the first slide member 33 on the other side (positive side in the Y-axis direction) engages with the linkage member 35.

The tapered member 332 may come into contact with a protrusion of the toner container 15. The tapered member 332 will be described later with reference to FIGS. 6A, 6B, and 7.

The engaging member 333 is located at the end of the first slide member 33 on the one side (negative side in the Y-axis direction). As a result of the engaging member 333 being fit into an engaging hole (not illustrate) formed in a frame of the casing 10, the front covering 2 is locked.

The urging member 34 urges the first slide member 33 in a negative direction of the Y axis. The urging member 34 includes for example a coil spring.

The linkage member 35 transmits movement of the first slide member 33 in the Y-axis direction to the second slide member 36. The second slide member 36 is slidable in the Y-axis direction. The engaging member 363 is disposed on an end of the second slide member 36 in the positive direction of the Y axis. As a result of the engaging member 363 being fitted into another engaging hole (not illustrated) formed in the frame of the casing 10, the front covering 2 is locked.

Figure 5:
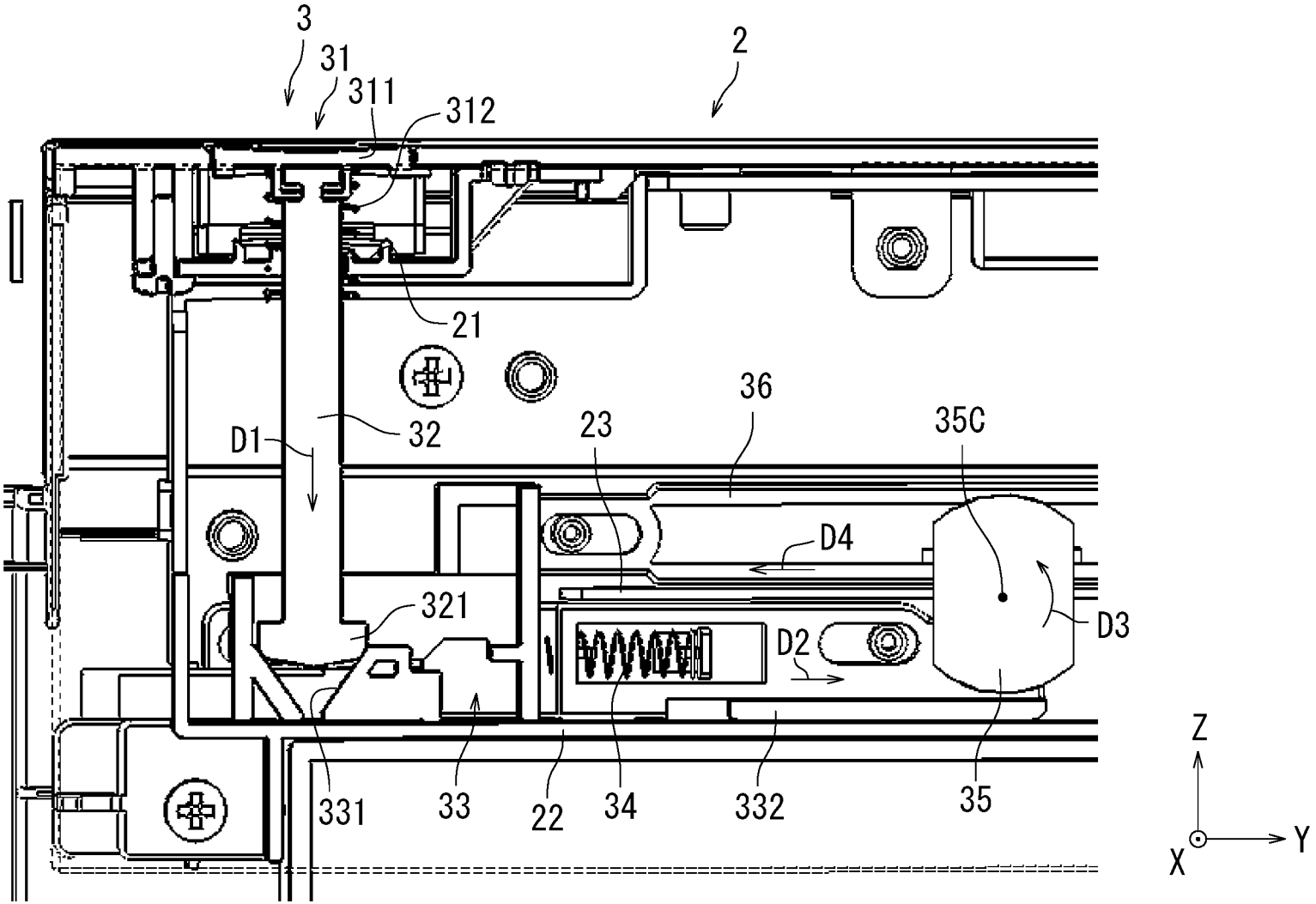
FIG. 5 is a rear view of the front covering that illustrates operation of the locking mechanism.

The following describes operation of the locking mechanism 3 with reference to FIGS. 1 to 5. FIG. 5 is a rear view of the front covering 2 that illustrates the configuration of the locking mechanism 3. As illustrated in FIG. 5, the linkage member 35 has a rotation center 35C. The linkage member 35 is rotatable about the rotation center 35C as a center.

The front covering 2 further includes a rib 23. The rib 23 stands on the front covering 2. The rib 23 protrudes from the front covering 2 in the positive direction of the X axis (rearward). The rib 23 is in a plate shape extending in the Y-axis direction. The rib 23 supports the second slide member 36 in a silidable manner.

The locking mechanism 3 is capable of transitioning between a locking state and an unlocking state. The following first describes operation by which the locking mechanism 3 goes into the unlocking state.

When the pressing member 31 is pressed by the user, the rod 32 moves in a negative direction of the Z axis (downward) as indicated by a first direction D1. When the rod 32 moves downward, the first slide member 33 moves in the positive direction of the Y axis (rightward) as indicated by a second direction D2 through the wedge member 321 and the tapered surface 331. Specifically, when the wedge member 321 moves downward, the tapered surface 331 is pushed rightward. The wedge member 321 then moves the first slide member 33 rightward against urging force by the urging member 34.

When the first slide member 33 moves rightward, engagement between the engaging member 333 and the corresponding engaging hole in the frame of the casing 10 is released to unlock the end of the front covering 2 on the one side (negative side in the Y-axis direction). In the following description, a position of the first slide member 33 where the front covering 2 is unlocked may be referred to as a "unlocking position".

Furthermore, when the first slide member 33 moves rightward, the linkage member 35 rotates anticlockwise about the rotation center 35C as a center as indicated by a direction D3. When the linkage member 35 rotates anticlockwise about the rotation center 35C as a center, the second slide member 36 moves in the negative direction of the Y axis (leftward) as indicated by a direction D4. The leftward movement of the second slide member 36 causes the engaging member 363 to fall out of the corresponding engaging hole in the frame of the casing 10 to unlock the end of the front covering 2 on the other side (positive side in the Y-axis direction).

As described with reference to FIG. 5, when the pressing member 31 is pressed by the user, the first slide member 33 moves rightward to the "unlocking position" to unlock the front covering 2. That is, the locking mechanism 3 is in the unlocking state.

The following describes operation by which the locking mechanism 3 goes into the locking state. When the pressing by the user on the pressing member 31 is removed, the urging force by the urging member 312 moves the rod 32 in a direction (positive direction of the Z axis, upward) opposite to the first direction D1. When the rod 32 moves upward, the urging force by the urging member 34 moves the first slide member 33 in a direction (negative direction of the Y axis, leftward) opposite to the second direction D2. When the first slide member 33 moves leftward, engagement between the engaging member 333 and the corresponding engaging hole in the frame of the casing 10 is established to lock the end of the front covering 2 on the one side (negative side in the Y-axis direction). A position of the first slide member 33 where the front covering 2 is locked may be referred to as a "locking position".

When the first slide member 33 moves leftward, the linkage member 35 rotates in a direction (clockwise) opposite to the direction D3. When the linkage member 35 rotates clockwise, the second slide member 36 moves in a direction (positive direction of the Y axis, rightward) opposite to the direction D4. The rightward movement of the second slide member 36 establishes engagement between the engaging member 363 located at the end of the second slide member 36 on the positive side in the Y-axis direction and the corresponding engaging hole in the frame of the casing 10 to lock the end of the front covering 2 on the other side (positive side in the Y-axis direction).

As described with reference to FIG. 5, when the pressing by the user on the pressing member 31 is removed, the first slide member 33 moves leftward to the "locking position" to lock the front covering 2. That is, the locking mechanism 3 is in the locking state.

As described with reference to FIGS. 1 to 5, the first slide member 33 moves from the "locking position" to the "unlocking position" according to the pressing on the pressing member 31. Thus, the locking mechanism 3 can be reduced to practice with such a simple configuration.

Figure 6A:
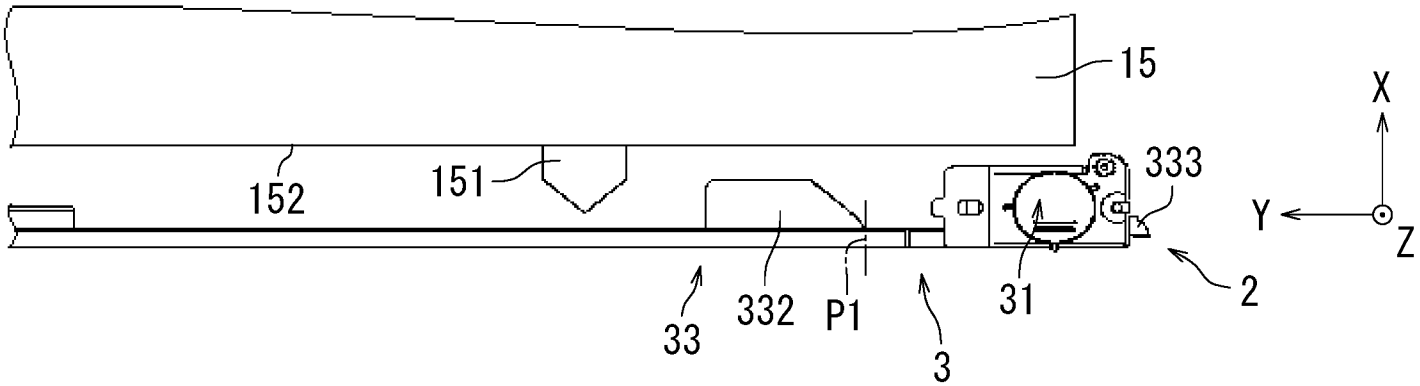
FIG. 6A is a plan view of operation of the locking mechanism upon attachment of an authorized toner container, which is a plan view of a locking state.
Figure 6B:
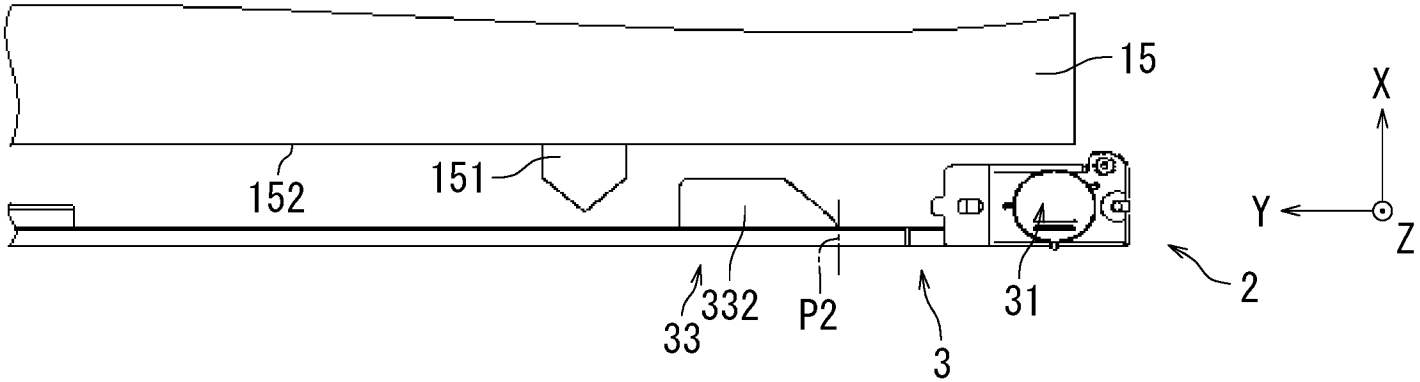
FIG. 6B is a plan view of operation of the locking mechanism upon attachment of the authorized toner container, which is a plan view of an unlocking state.

The following describes an authorized toner container 15 with reference to FIGS. 3 to 6B. FIGS. 6A and 6B are plan views of operation of the locking mechanism 3 when the authorized toner container 15 is attached. FIG. 6A is a plan view of the locking state. FIG. 6B is a plan view of the unlocking state.

As illustrated in FIGS. 6A and 6B, the toner container 15 includes a protrusion 151 and a side surface 152. The side surface 152 faces the front covering 2. The protrusion 151 protrudes from the side surface 152 in a negative direction of the X axis. The protrusion 151 is in a pentagonal prism shape in the embodiment of the present invention. The protrusion 151 extends in a Z-axis direction.

As illustrated in FIG. 6A, an end of the tapered member 332 on the negative side in the Y-axis direction is located at a position P1. In this state, the engaging member 333 protrudes in the negative direction of the Y axis to engage with the corresponding engaging hole in the frame of the casing 10, thereby locking the front covering 2. In this manner, the locking mechanism 3 is in the locking state in FIG. 6A. In the embodiment of the present invention, a state in which the end of the tapered member 332 on the negative side in the Y-axis direction is located at the position P1 is referred to as a state in which the first slide member 33 is located at the "locking position".

As illustrated in FIG. 6B, the end of the tapered member 332 on the negative side in the Y-axis direction is located at a position P2. In this state, the engaging member 333 retreats in the positive direction of the Y-axis to release engagement between the engaging member 333 and the corresponding engaging hole in the frame of the casing 10, thereby unlocking the front covering 2. In this manner, the locking mechanism 3 is in the unlocking state in FIG. 6B. In the embodiment of the present invention, a state in which the end of the tapered member 332 on the negative side in the Y-axis direction is located at the position P2 is referred to as a state in which the first slide member 33 is located at the "unlocking position".

The first slide member 33 moves between the "locking position" illustrated in FIG. 6A and the "unlocking position" illustrated in FIG. 6B. As the first slide member 33 moves, the tapered member 332 moves between the "locking position" illustrated in FIG. 6A and the "unlocking position" illustrated in FIG. 6B.

As illustrated in FIG. 6A, the protrusion 151 is located on a side of the tapered member 332 in the positive direction of the Y axis when the locking mechanism 3 is in the locking state. As illustrated in FIG. 6A, the protrusion 151 is also located on a side of the tapered member 332 in the positive direction of the Y axis when the locking mechanism 3 is in the locking state. In the above configuration, the protrusion 151 does not come into contact with the tapered member 332. Therefore, the locking mechanism 3 operates according to opening or closing of the front covering 2.

In the embodiment of the present invention, a case where the protrusion is provided at a position out of contact with the tapered member 332 as described above is referred to as a case where the protrusion 151 is provided at a "specific position" of the toner container 15. That is, the "specific position" is a position where the protrusion 151 does not come into contact with the tapered member 332.

As described with reference to FIGS. 3 to 6B, the locking mechanism 3 operates according to opening or closing of the front covering 2 in a case where the protrusion 151 is provided at the "specific position" of the toner container 15.

Figure 7A:
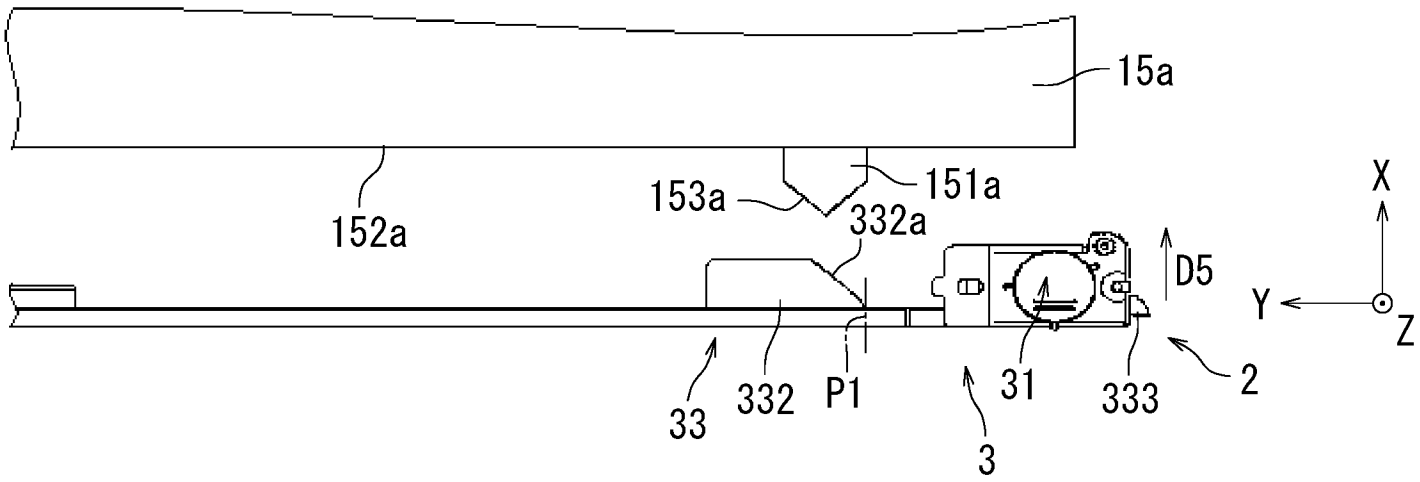
FIG. 7A is a plan view of operation of the locking mechanism upon attachment of an unauthorized toner container, which is a plan view of a state before the front covering is closed.
Figure 7B:
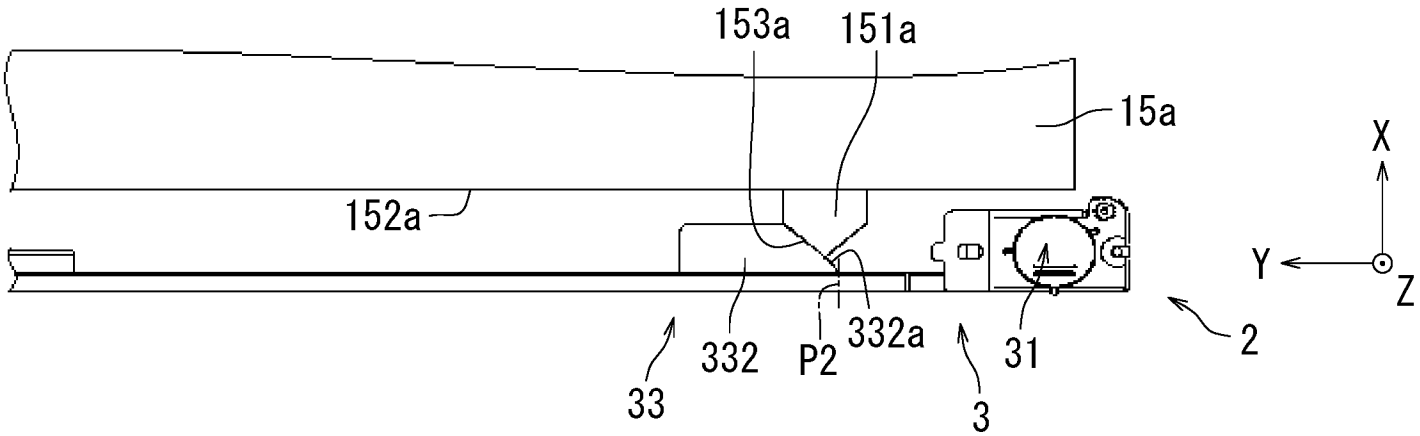
FIG. 7B is a plan view of operation of the locking mechanism upon attachment of the unauthorized toner container, which is a plan view of the unlocking state.

Description will be made next about an unauthorized toner container 15*a* with reference to FIGS. 3 to 5, 7A, and 7B. FIGS. 7A and 7B are plan views of operation of the locking mechanism 3 when the unauthorized toner container 15*a* is attached. FIG. 7A is a plan view of a state before the front covering 2 is closed. FIG. 7B is a plan view of the unlocking state.

As illustrated in FIGS. 7A and 7B, the toner container 15*a* includes a protrusion 151*a* and a side surface 152*a*. The side surface 152*a* faces the front covering 2. The protrusion 151*a* protrudes from the side surface 152*a* in the negative direction of the X axis. The protrusion 151*a* is in a pentagonal prism shape in the embodiment of the present invention. The protrusion 151*a* extends in the Z-axis direction.

Before the front covering 2 is closed, the first slide member 33 is located at the "locking position" while the end of the tapered member 332 on the negative side in the Y-axis direction is located at the position P1 as illustrated in FIG. 7A. From the state illustrated in FIG. 7A, the front covering 2 is moved in the positive direction of the X axis as indicated by a direction D5.

As a result, the locking mechanism 3 goes into the unlocking state as illustrated in FIG. 7B. Specifically, the protrusion 151*a* includes a first tapered portion 153*a* and the tapered member 332 includes a second tapered portion 332*a*. When the front covering 2 is moved in the positive direction of the X axis as indicated by the direction D5, the first tapered portion 153*a* comes into contact with the second tapered portion 332*a* to push the second tapered portion 332*a* in the positive direction of the Y axis (leftward). The tapered member 332 then moves in the positive direction of the Y axis (leftward), resulting in movement of the end of the tapered member 332 on the negative side in the Y-axis direction to the position P2. That is, the first slide member 33 is located at the "unlocking position" and the locking mechanism 3 is in the unlocking state.

As described with reference to FIGS. 3 to 5, 7A, and 7B, the locking mechanism 3 does not operate in a case where the protrusion 151 is not provided at the "specific position". The front covering 2 accordingly cannot be locked in the closed state. Thus, use of the unauthorized toner container 15*a* can be restricted.

In a case where the protrusion 151 is not provided at the "specific position", movement of the first slide member 33 from the "unlocking position" to the "locking position" is restricted by the protrusion 151 to maintain the unlocking state of the locking mechanism 3. In the above configuration, the operation of the locking mechanism 3 can be inhibited in a case where the protrusion 151 is not provided at the "specific position".

Furthermore, in a case where the protrusion 151 is not provided at the "specific position", the first tapered portion 153*a* keeps the first slide member 33 at the "unlocking position" when the front covering 2 is closed. In the above configuration, the front covering 2 is kept open in a case where the protrusion 151 is not provided at the "specific position". Furthermore, during the front covering 2 being open, the controller 4 inhibits the operation of the image forming section 14. Thus, use of the unauthorized toner container 15*a* can be effectively restricted.

In a case where the protrusion 151 is not provided at the "specific position", the first tapered portion 153*a* comes into contact with the second tapered portion 332*a* when the front covering 2 is close, thereby keeping the first slide member 33 at the "unlocking position". Thus, the front covering 2 is kept open in a case where the protrusion 151 is not provided at the "specific position". Moreover, the controller inhibits 4 the operation of the image forming section 14 during the front covering 2 being open. In the above configuration, use of the unauthorized toner container 15*a* can be effectively restricted.

Figure 8:
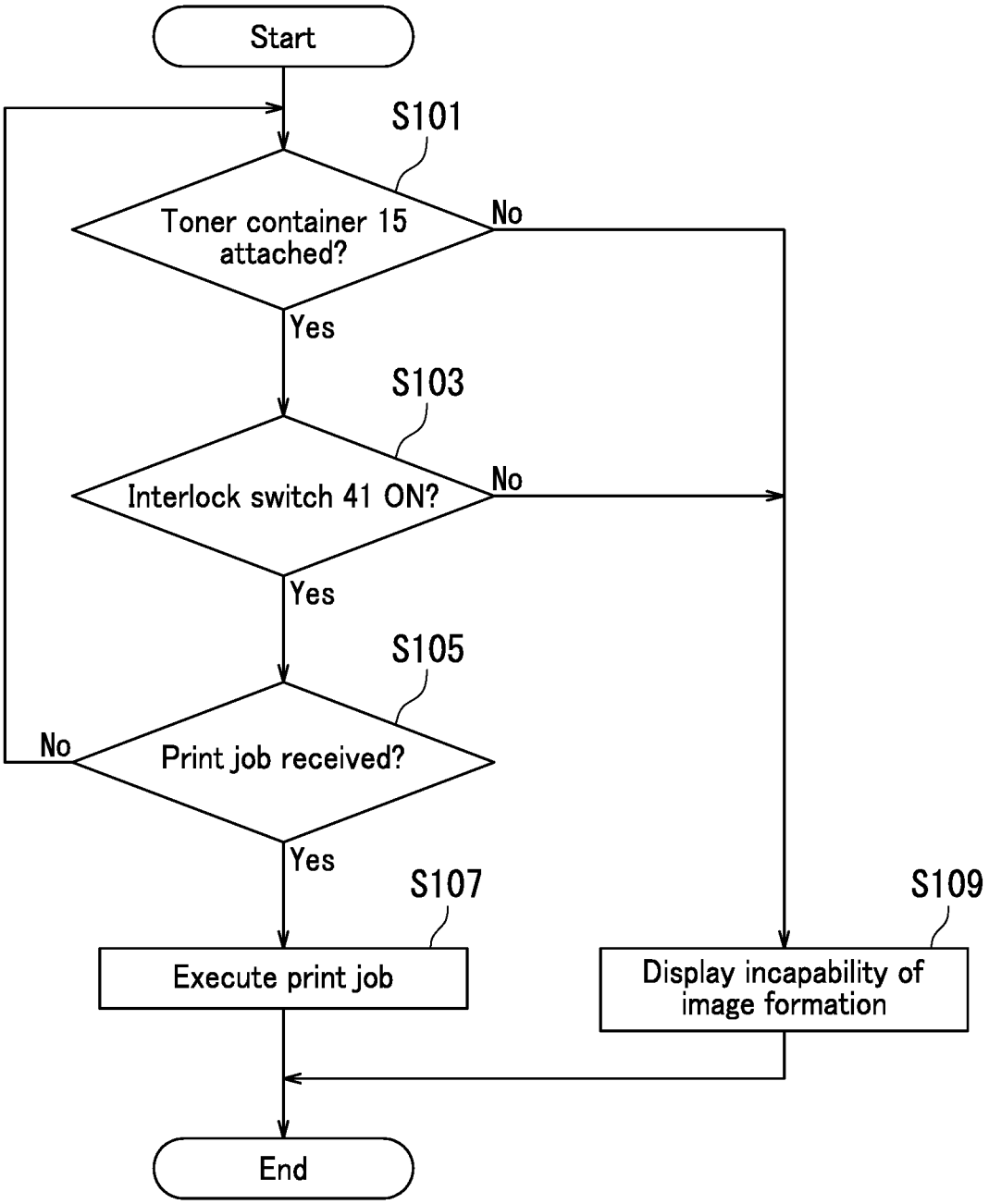
FIG. 8 is a flowchart depicting a process performed by a controller.

The following describes a process performed by the controller 4 with reference to FIGS. 1 to 8. FIG. 8 is a flowchart depicting the process performed by the controller 4.

As depicted in FIG. 8, the controller 4 determines whether or not any toner container 15 has been attached in Step S101. Specifically, the controller 4 determines whether or not any toner container 15 has been attached according to the detection signal from the sensor S. The sensor S detects whether or not a toner container 15 has been attached.

When the controller 4 determines that no toner container 15 has been attached, (NO in Step S101), the routine proceeds to Step S109. When the controller 4 determines that the toner container 15 has been attached, (YES in Step S101), the routine proceeds to Step S103.

In Step S103, the controller 4 determines whether or not the interlock switch 41 has been on.

When the controller 4 determines that the interlock switch 41 has not been on (NO in Step S103), the routine proceeds to Step S109. When the controller 4 determines that the interlock switch 41 has been on (YES in Step S103), the routine proceeds to Step S105.

In Step S105, the controller 4 determines whether or not any print job has been received from a terminal device such as a personal computer.

When the controller 4 determines that no print job has been received (NO in Step S105), the routine returns to Step S101. When the controller 4 determines that the print job has been received (YES in Step S105), the routine proceeds to Step S107.

In Step S107, the controller 4 instructs the image forming section 14 to execute the print job and the process ends.

When a negative determination is made in Step S101 or negative determination is made in Step S103, the controller 4 causes a display to display indication of incapability of image formation on paper and the process ends. The display is disposed on an operation panel of the image forming apparatus 1.

During the locking mechanism 3 not locking the front covering 2, the interlock switch 41 is off to cause the controller 4 to inhibit the operation of the image forming section 14 as described with reference to FIGS. 1 to 8. When the unauthorized toner container 15*a* is attached, the locking mechanism 3 is maintained in the unlocking state. In the above configuration, the operation of the image forming section 14 is inhibited in a situation in which the unauthorized toner container 15*a* is attached. Thus, use of the unauthorized toner container 15*a* can further be effectively restricted.

An embodiment of the present invention has been described so far with reference to the drawings. The present invention is not limited to the above embodiment and may be implemented in various different forms that do not deviate from the essence of the present invention (for example, as described below in sections (1) and (2)). The drawings schematically illustrate elements of configuration in order to facilitate understanding. Properties of the elements of configuration illustrated in the drawings, such as thickness, length, and quantity may differ from reality in order to aid preparation of the drawings. Furthermore, properties of the elements of configuration described in the above embodiment, such as shapes and dimensions, are merely examples and are not intended as specific limitations. Various alterations may be made so long as there is no substantial deviation from the effects of the present invention.

(1) As described with reference to FIGS. 1 to 8, the covering is the front covering 2, which should not be taken to limit the present invention. It is only required that the covering be opened and closed for attachment or detachment of the toner container 15. The covering may be located for example in the rear surface of the casing 10.

(2) As described with reference to FIGS. 1 to 8, the protrusion 151 is in a pentagonal prism shape, which should not be taken to limit the present invention. The locking mechanism 3 can operate according to opening or closing of the front covering 2 only in a case where the protrusion 151 is provided at the "specific position". The protrusion 151 may for example be in a triangular prism shape.

INDUSTRIAL APPLICABILITY

The present invention relates to an image forming apparatus and therefore has industrial applicability.

The invention claimed is:

1. An image forming apparatus comprising:

a covering configured to be opened and closed in attachment or detachment of a toner container; and a locking mechanism configured to lock the covering, wherein the toner container includes a protrusion, the covering includes a slide member that moves between an unlocking position and a locking position, the locking mechanism transitions between an unlocking state and a locking state as the slide member moves from the unlocking position to the locking position, and when the protrusion is not provided at a specific position, movement of the slide member from the unlocking position to the locking position is restricted by the protrusion.

2. The image forming apparatus according to claim 1, wherein the protrusion of the toner container includes a first tapered portion, and in a case where the protrusion is not provided at the specific position, the slide member of the covering is kept at the unlocking position by the first tapered portion when the covering is closed.

3. The image forming apparatus according to claim 2, wherein the slide member of the covering includes a second tapered portion, and in a case where the protrusion is not provided at the specific position, the slide member is kept at the unlocking position through the first tapered portion of the protrusion coming into contact with the second tapered portion when the covering is closed.

4. The image forming apparatus according to claim 1, further comprising a pressing member, wherein as the pressing member is pressed, the slide member of the covering moves from the locking position to the unlocking position.

5. The image forming apparatus according to claim 4, further comprising a rod, wherein as the pressing member is pressed, the rod moves in a first direction, the rod includes a wedge member, the wedge member is located at a tip end of the rod in the first direction, as the rod moves in the first direction, the wedge member moves the slide member in a second direction from the locking position to the unlocking position, and the second direction is a direction intersecting with the first direction.

6. The image forming apparatus according to claim 1, further comprising:

an image forming section configured to form an image on a recording medium;

a controller configured to control operation of the image forming section; and an interlock switch configured to detect whether or not the covering is locked, wherein the interlock switch is off during the locking mechanism unlocking the covering, and the controller restricts the operation of the image forming section during the interlock switch being off.

7. The image forming apparatus according to claim 1, wherein only when the protrusion is provided at a specific position of the toner container, the locking mechanism operates according to opening or closing of the covering.

* * * * *